US008360798B2

(12) United States Patent
Gabrielsson

(10) Patent No.: US 8,360,798 B2
(45) Date of Patent: Jan. 29, 2013

(54) CONNECTOR

(75) Inventor: Per Georg Gabrielsson, Hasselby (SE)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/736,610

(22) PCT Filed: Apr. 24, 2008

(86) PCT No.: PCT/IB2008/001543

§ 371 (c)(1),
(2), (4) Date: Mar. 9, 2011

(87) PCT Pub. No.: WO2009/130529

PCT Pub. Date: Oct. 29, 2009

(65) Prior Publication Data

US 2012/0003858 A1 Jan. 5, 2012

(51) Int. Cl.
*H01R 13/62* (2006.01)

(52) U.S. Cl. ..... 439/352

(58) Field of Classification Search ..... 439/352
See application file for complete search history.

(56) References Cited

U.S. PATENT DOCUMENTS

| | | | | |
|---|---|---|---|---|
| 4,954,097 | A * | 9/1990 | Sekiguchi | 439/352 |
| 5,011,424 | A | 4/1991 | Simmons | 439/352 |
| 5,383,794 | A | 1/1995 | Davis et al. | 439/352 |
| 5,435,744 | A * | 7/1995 | Derstine et al. | 439/352 |
| 5,580,268 | A * | 12/1996 | Miyazawa | 439/352 |
| 6,042,157 | A | 3/2000 | Shimotsu | 292/83 |
| 6,059,597 | A * | 5/2000 | Endo et al. | 439/352 |
| 6,296,399 | B1 | 10/2001 | Halbach et al. | 385/81 |
| 6,312,277 | B1 * | 11/2001 | Holub | 439/352 |
| 6,450,697 | B1 | 9/2002 | Ngo | 385/78 |
| 6,575,640 | B2 | 6/2003 | Connelly et al. | 385/69 |
| 6,641,425 | B1 | 11/2003 | Wu | 439/352 |
| 7,175,465 | B1 * | 2/2007 | Tsai | 439/352 |
| 7,234,879 | B2 | 6/2007 | Schrodinger | 385/89 |

FOREIGN PATENT DOCUMENTS

WO WO-2007/059798 A1 5/2007

OTHER PUBLICATIONS

Rule 94.3 issued for corresponding European Patent Application 08 762 875.6-1231 dated Nov. 24, 2011.

* cited by examiner

*Primary Examiner* — Gary F. Paumen
(74) *Attorney, Agent, or Firm* — Harrington & Smith

(57) ABSTRACT

Connector including a connector housing and at least one resilient lock lever supported by the connector housing. The lever has a flexible free end including a locking cam projecting out of the housing. A release member, such as a sliding cover, is moveable between a locking position and a release position, the release member being provided with a pressure surface for engaging a section of the lever when the release member is moved to the release position. A resilient member biases the release member to the locking position. The lock lever can for example be a leaf spring.

10 Claims, 4 Drawing Sheets

CONNECTOR

FIELD OF THE DISCLOSURE

The present invention relates to the field of connectors, in particular electrical or optical cable connectors, e.g., for data transmission.

BACKGROUND OF THE DISCLOSURE

After plugging a cable connector into a matching counterpart, unintentional disconnection can result in disruption of data transmission or electrical power. To prevent unintentional disconnection, it has been proposed to use a releasable lock lever as disclosed in U.S. Pat. No. 6,042,157 which is releasable by pulling a sliding cover. Unintentional displacement of the sliding cover is still possible which may cause the unintentional unlocking of the connectors.

An object of the invention is to provide for a cable connector allowing reducing the risk of unintentional disconnection and which can be used in a simple and easy way.

SUMMARY OF THE DISCLOSURE

The object of the present invention is achieved with a cable connector according to claim 1.

This way, after connection with the counter-part connector, the locking lever is urged to its locking position so as, unless a threshold force is intentionally applied on the release member to bring it to its release position, the risk of inadvertent disconnection is reduced and a firm connection between the connector and its counterpart is obtained. It should be also mentioned that thanks to the cable connector of the present invention, when a pulling force is exerted on the cable, the risk of unlocking is further greatly reduced. The issue of inadvertent disconnection is of major importance where power is transferred between the cable connector and its counter-part.

According to a preferred embodiment, the locking lever is fixedly retained in respect to the longitudinal axis of the connector housing. However, it should be understood that the resilient lock lever may be capable to slide to a certain extent in respect to the longitudinal axis of the connector housing without departing from the scope of the invention.

The resilient member is for example an outer end received in a recess defining a displacement stroke of the release member wherein the outer end of the resilient member resiliently engages a surface of the recess biasing the release member to its locking position.

Optionally, the resilient member is connected to the connector housing and the receiving recess is in the release member; with these features a compact connector is provided.

The release member is for instance a sliding cover, such as a sliding sleeve enveloping the connector housing. By displacing the sliding cover, a pressure is applied on the lever that increases with further sliding of the cover. As a result, the locking cam of free end of the lever is pushed out of its locking position and the connector can be released.

In a particular embodiment the pressure surface of the release member is a slanting surface engaging a projection on the lever. The slanting surface can for example be a bottom surface of a recess in an interior surface of the release member. Alternatively, the pressure surface of the release member can be a projection engaging a slanting surface of the lever.

The lock lever is for example a leaf spring bent to form a locking cam at its free end. Such a leaf spring is for example bent to form a projection engaging the pressure surface of the release member. Using such a leaf spring, the biasing resilient member is for example formed by an outer end of the leaf spring projecting from the housing. To improve the resilient behaviour, the outer end can for instance be the outer tip of a V-shaped section of the leaf spring.

Optionally, the leaf spring is bent to form a projection between the end of the sliding release member and a projection of the housing. Such a bent part of the leaf spring will show some resiliency when it is clamped between the release member and the projection of the housing and when the release member is in the locking position.

DETAILED DESCRIPTION OF EMBODIMENTS

Figure 1:
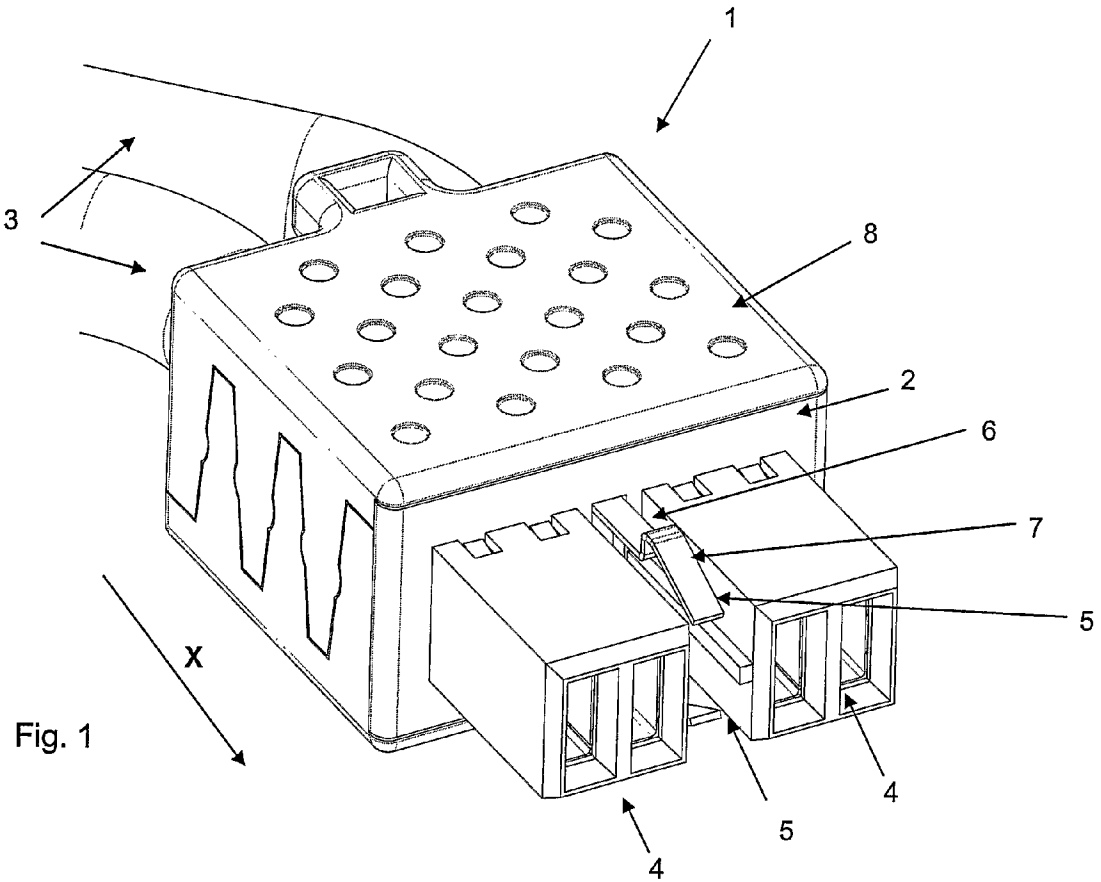
FIG. 1: shows in perspective view a connector according to the present invention.

FIG. 1 shows in perspective view a cable connector comprising a connector housing 2 extending along a longitudinal axis (X) between a first and a second end. The housing receives two cables 3 at its first end and comprises two connection blocks 4 at its second end. The connection blocks 4 are dimensioned to be plugged into a matching connector. Between the connection blocks 4 are the free ends 5 of two resilient levers 6, also referred to as lock levers or levers, formed by a shaped leaf spring. These free ends 5 are shaped to form a locking cam 7 which is dimensioned to engage a matching notch or recess in the mating connector after plugging in the connection blocks 4. The locking levers are fixedly retained in position in respect to the longitudinal axis (X) of the connector housing.

Figure 2:
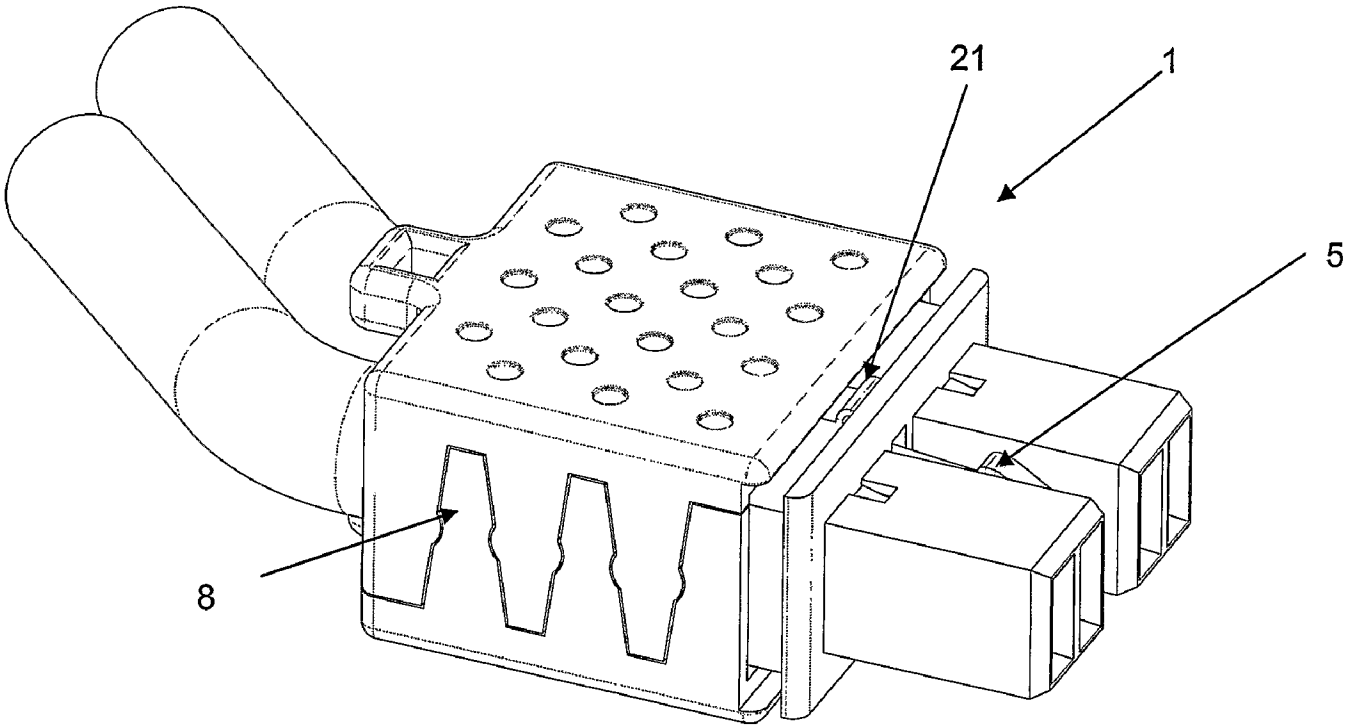
FIG. 2: shows the connector of FIG. 1 in a releasable mode.

The connector 1 further comprises a sliding cover 8, also referred to as a release member formed as a sliding sleeve enveloping the housing 2. The sliding cover 8 can be slid between a locking position (forward position), shown in FIG. 1 and FIG. 3, and a release position (rearward position), as shown in FIG. 2 and FIG. 4.

Figure 3:
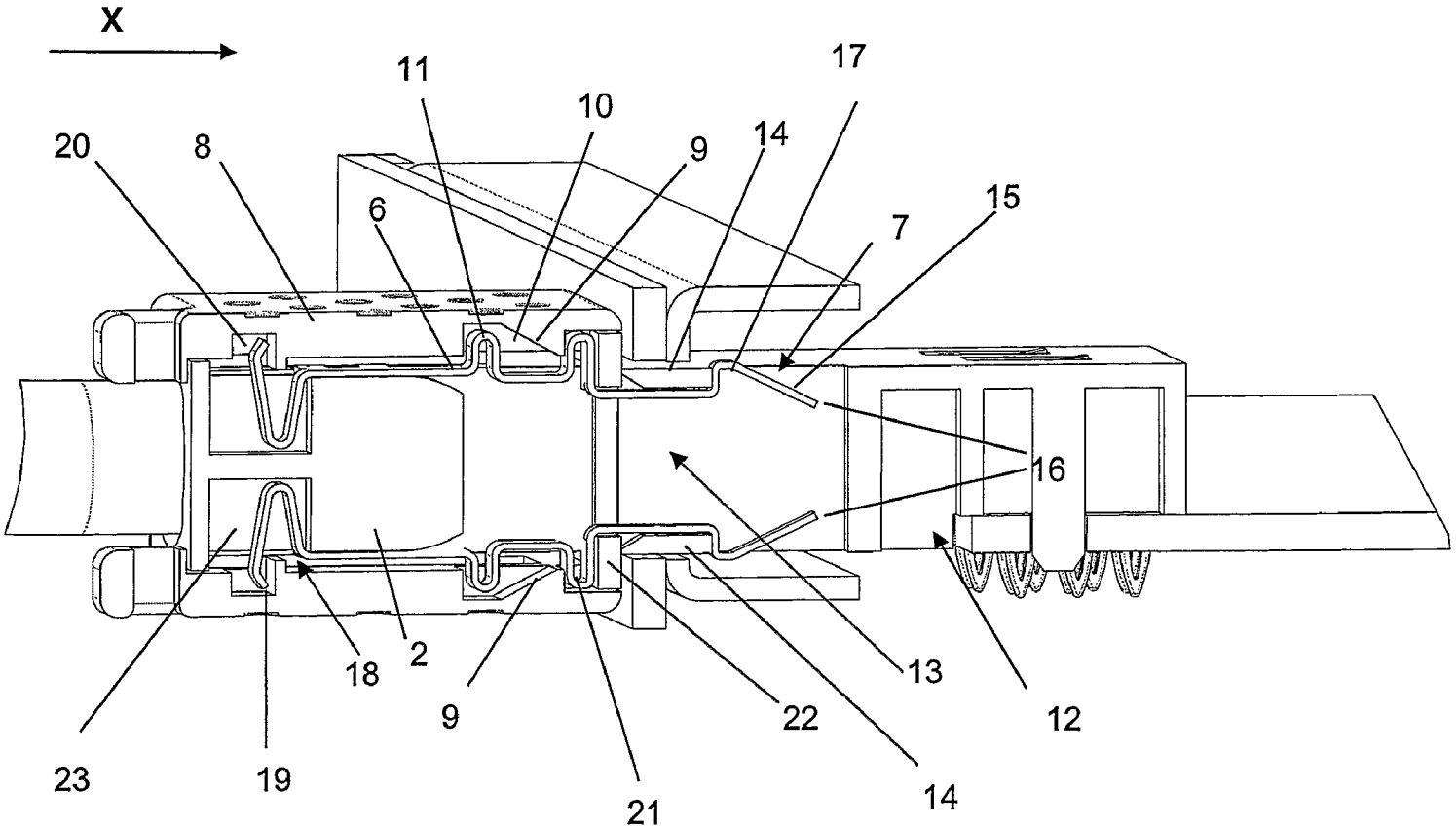
FIG. 3: shows in cross section the connector of FIG. 1.
Figure 4:
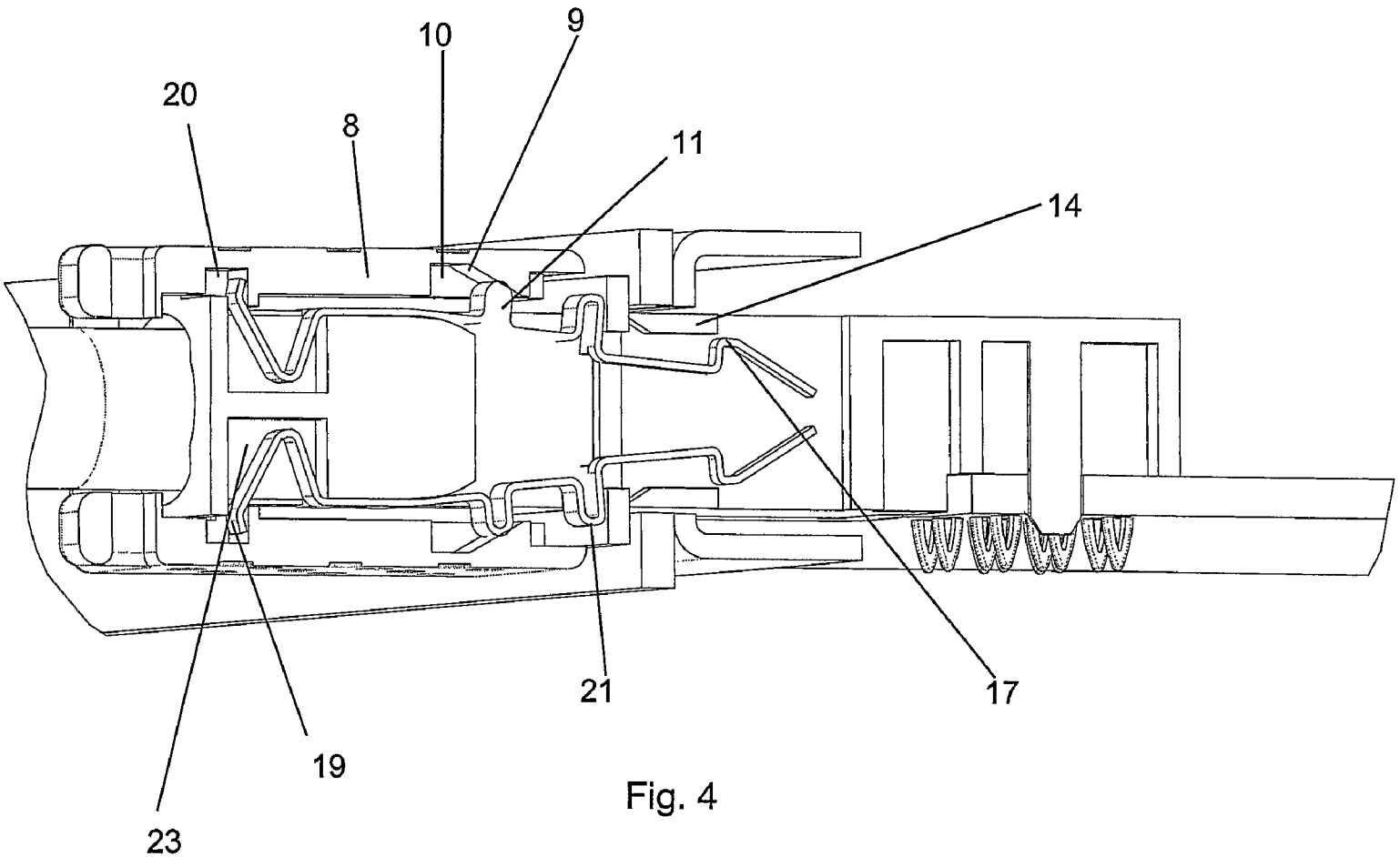
FIG. 4: shows in cross section the connector of FIG. 1 in a releasable mode.

As shown in cross section in FIG. 3, one end of lever 6 is within the housing 2 and is covered by the sliding cover 8. The sliding cover 8 is provided with a pressure surface 9 formed by a slanting bottom of a recess 10. The levers 6 are provided with a projection 11 projecting into the respective recesses 10. The angle of the slanted portion with respect to the longitudinal axis (X) is determined so as, when the sliding cover 8 is displaced to the rearward position shown in FIG. 4, the slanted surface 9 engages the projection 11 of the corresponding lever 6 and pushes it inwardly. The cross section of FIG. 3 is just between the connection blocks 4 which, as a consequence, are not shown in this Figure and which are inserted in a mating receiving connection block 12. This connection block 12 comprises a vertical slot 13 confined by two locking portions 14. The cam shaped free ends 7 of the levers 6 have a slanting end section 15. In the direction to its outer end 16 the slanting end section 15 slopes under a small angle towards the longitudinal centre line of the connector. The slanting end 15 is confined by a hook part 17, substantially under right angle with the centre line of the connector. When coupling the connector 1 to a mating connection block 12, the slanting ends 15 are inserted in the slot 13. The locking portions 14 push the slanting ends 15 towards the connector centre line. The connector 1 is pushed further until the hook parts 17 snap behind the locking portions 14. The angle between the hook part 17 and the connector centre line is such that unintentional removal of the connector 1 is prevented.

The ends of levers 6 within the housing 2 have V-shaped sections 18 moveable in a cavity 23 in the housing 2. The outer tips 19 of the V-shaped sections 18 project outwardly into a recess 20 in the sliding cover 8. The outer tips 19 are slightly bent against the sliding cover 8 to resiliently engage the end wall of recess 20. When the sliding cover 8 is moved to the release position, as shown in FIG. 4, the force exerted by the tips 19 on the cover 8 increases and forces the cover 8 to return to the locking position as soon as there is no larger contrary force anymore. It has to be noted that the V-shaped section 18 is not necessarily an integral part of the locking lever but could also be an independent element.

According to another embodiment (not shown), the resilient member can be a distinct spring element, e.g. a coil spring or a flexible spring tab, captured in a receiving cavity defined in the connector housing. Such a spring element is biased by the sliding cover, i.e. the release member, under pulling force applied onto the latter. The spring element can then restore the accumulated energy so as to urge the release member back to its locking position when no more pulling force is exerted onto the release member.

Between the projection 11 and the hook part 17, the leaf spring lever 6 is bent to form a U-shaped projection 21 between a terminal projection 22 of the housing 2 and an end section of the sliding cover 8. When the hook part 17 is hooked behind the locking portion 14, projection 21 resiliently clamps against the projection 22 of the housing 2.

The connection between the cable connector 1 and the connection block 12 can be released by pulling the sliding cover 8 away from the connection block 12. When sliding the sliding cover 8 the slanting surface 9 in recess 10 pushes the lever 6 to the connector centre line and the hook parts 17 are lifted from the locking parts 14, as shown in FIG. 4. The connector 1 can now be disconnected from the connection block 12.

The invention claimed is:

1. Connector comprising:

a connector housing;

at least one resilient lock lever supported by the connector housing and having a flexible free end comprising a locking cam projecting out of the housing;

a release member slidingly moveable with respect to the connector housing between a locking position and a release position, the release member being provided with a pressure surface for engaging a section of the lever when the release member is moved to the release position;

a resilient member for biasing the release member to the locking position, wherein the resilient member is part of the resilient lock lever.

2. Connector according to claim 1, wherein the lock lever is a leaf spring bent to form a cam at one of its free ends.

3. Connector according to claim 2, wherein the leaf spring is bent to form a projection between the end of the sliding cover and a projection of the housing.

4. Connector according to claim 1, wherein the resilient member has an outer end adapted for resiliently biasing the release member to its locking position.

5. Connector according to claim 1 wherein the release member is a sliding cover.

6. Connector according to claim 1, wherein the pressure surface of the release member is a slanting surface adapted to engage a projection on the lever.

7. Connector according to claim 6, wherein the slanting surface is a bottom surface of a recess in an interior surface of the release member.

8. Connector comprising:

a connector housing;

at least one resilient lock lever supported by the connector housing and having a flexible free end comprising a locking cam projecting out of the housing;

a release member slidingly moveable with respect to the connector housing between a locking position and a release position, the release member being provided with a pressure surface for engaging a section of the lever when the release member is moved to the release position;

a resilient member for biasing the release member to the locking position, wherein the resilient member has an outer end adapted for resiliently biasing the release member to its locking position, and wherein the resilient member is received in a cavity of the connector housing and the outer end is engaged with a receiving recess formed in the release member.

9. Connector comprising:

a connector housing;

at least one resilient lock lever supported by the connector housing and having a flexible free end comprising a locking cam projecting out of the housing;

a release member slidingly moveable with respect to the connector housing between a locking position and a release position, the release member being provided with a pressure surface for engaging a section of the lever when the release member is moved to the release position;

a resilient member for biasing the release member to the locking position, wherein the resilient member has an outer end adapted for resiliently biasing the release member to its locking position, and wherein the outer end is the outer tip of a V-shaped section of a leaf spring.

10. Connector comprising:

a connector housing;

at least one resilient lock lever formed by a leaf spring supported by the connector housing and having a flexible free end bent to form a locking cam projecting out of the housing;

a sliding release cover sliding between a locking position and a release position, the release member being provided with a recess with a slanting bottom for engaging a section of the spring leaf bent to form a projection, with an increasing pressure force when the release member is moved to its release position;

wherein the leaf spring comprises a second outer end bent in a V-shape with a free outer tip resiliently engaging a wall in a recess in the sliding cover to bias the sliding cover to the locking position.

* * * * *